US006699093B1

(12) United States Patent
Cacciola et al.

(10) Patent No.: US 6,699,093 B1
(45) Date of Patent: Mar. 2, 2004

(54) EVENT-ACTIVATED TOY

(75) Inventors: Joseph Cacciola, Wrentham, MA (US); Todd Michael Meaney, Newport, RI (US); Lamont Curtis Morris, Hope, RI (US); Gregory R. Horton, Manville, RI (US)

(73) Assignee: Hasbro, Inc., Pawtucket, RI (US)

( * ) Notice: Subject to any disclaimer, the term of this patent is extended or adjusted under 35 U.S.C. 154(b) by 246 days.

(21) Appl. No.: 09/871,709

(22) Filed: Jun. 4, 2001

(51) Int. Cl.[7] ..... A63H 11/00
(52) U.S. Cl. ..... 446/175; 446/397
(58) Field of Search ..... 463/51, 52, 2; 446/175, 397, 404, 408, 484; 273/460

(56) References Cited

U.S. PATENT DOCUMENTS 4,333,262 A * 6/1982 Kimura ..... 136/291
4,659,919 A 4/1987 Price
4,984,380 A 1/1991 Anderson
5,589,654 A 12/1996 Konwiser et al.
5,971,761 A 10/1999 Tillman, Sr.
6,142,849 A * 11/2000 Horton et al. ..... 446/175
6,224,454 B1 * 5/2001 Cheng et al. ..... 446/175
6,253,058 B1 * 6/2001 Murasaki et al. ..... 434/308
6,254,486 B1 * 7/2001 Mathieu et al. ..... 446/175

* cited by examiner

*Primary Examiner*—Jacob K. Ackun
(74) *Attorney, Agent, or Firm*—Fish & Richardson P.C.

(57) ABSTRACT

A toy includes a device that defines a perimeter and a control unit coupled to the boundary device. The control unit includes a detector that senses an event, an output device, and a controller. The controller receives input from the detector and sends an output signal to the output device when the detector senses an event that occurs within the perimeter.

32 Claims, 5 Drawing Sheets

EVENT-ACTIVATED TOY

TECHNICAL FIELD

This invention relates to event-activated toys.

BACKGROUND

Event-activated toys are well known. For example, a crib mobile may be turned on in response to activity by an infant.

SUMMARY

In one general aspect, a toy includes a boundary device that defines a perimeter and a control unit connected to the boundary device. The control unit includes a detector that senses an event, an output device, and a controller. The controller receives input from the detector and sends an output signal to the output device to perform an action when the detector senses an event that occurs within the perimeter.

Implementations may include one or more of the following features. For example, the boundary device may includes two or more curved segments that are assembled using a fastening mechanism. In another design, the boundary device may be circular.

The control unit may include an input mechanism for receiving input from a player. The input mechanism may include a push-button. The controller may cause the output device to perform a second action when the controller receives input from the input mechanism. The output device may include a speaker. If so, the controller may cause the speaker to play a sound when the event occurs within the perimeter and to play a second sound when the controller receives input from the input mechanism. Alternatively, the controller may cause the speaker to play music when the event occurs within the perimeter and to play the music at a faster speed when the controller receives input from the input mechanism.

The controller may enter a limited mode when the controller determines that input from the detector has not been received for a period of time that is longer than a predetermined time duration. The controller processes input only from the input mechanism during limited mode operation and cannot process input from the detector during that time. The controller may enter limited mode when the controller receives input from the input mechanism to enter limited mode. The controller may disengage the detector after the detector senses the event that occurs within the perimeter. The controller may then engage the detector after a second predetermined time duration following disengagement. The controller may cause the output device to perform the action for a third predetermined duration of time. The second predetermined time duration may lapse before the end of the third predetermined time duration. The controller may cause the output device to continuously perform the action when the detector senses the event that occurs within the perimeter before the end of the third predetermined time duration and after the end of the second predetermined time duration.

The detector may measure an ambient light intensity within a visual field and the event may include a change in ambient light intensity that occurs when a player moves within the visual field of the detector.

In another general aspect, a toy includes a boundary device that defines a perimeter and a control unit coupled to the boundary device. The control unit includes a detector that senses an event, an output device, a controller, and an input mechanism. The controller receives input from the detector and sends an output signal to the output device to perform an action when the detector senses an event that occurs within the perimeter. The input mechanism receives input from a player. The controller causes the output device to alter the action when the controller receives input from the input mechanism during performance of the action.

Implementations may include one or more of the following features. For example, the action may be altered by changing a type of action that is performed. Alternatively, the action may be altered by changing a speed at which the action is performed.

Other features and advantages will be apparent from the description, the drawings, and the claims.

DESCRIPTION OF DRAWINGS

Like reference symbols in the various drawings indicate like elements.

DETAILED DESCRIPTION

Figure 1:
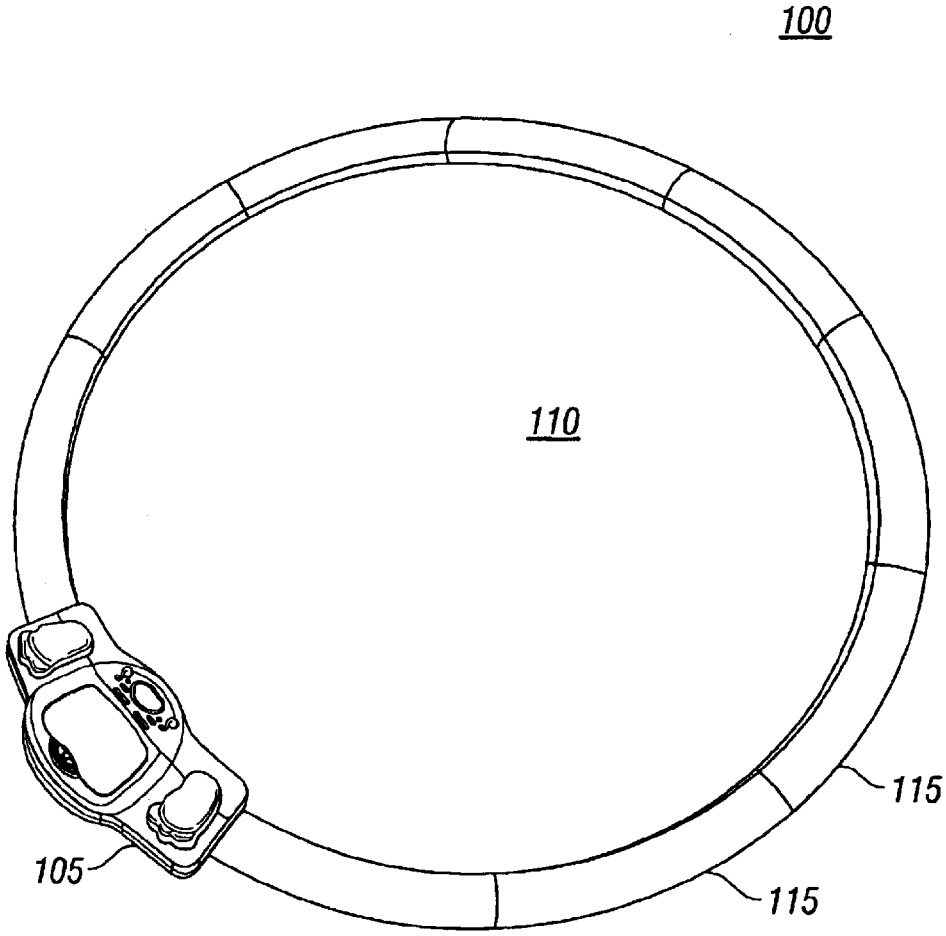
FIG. 1 is a perspective view of a toy having a boundary device and a control unit.
Figure 2:
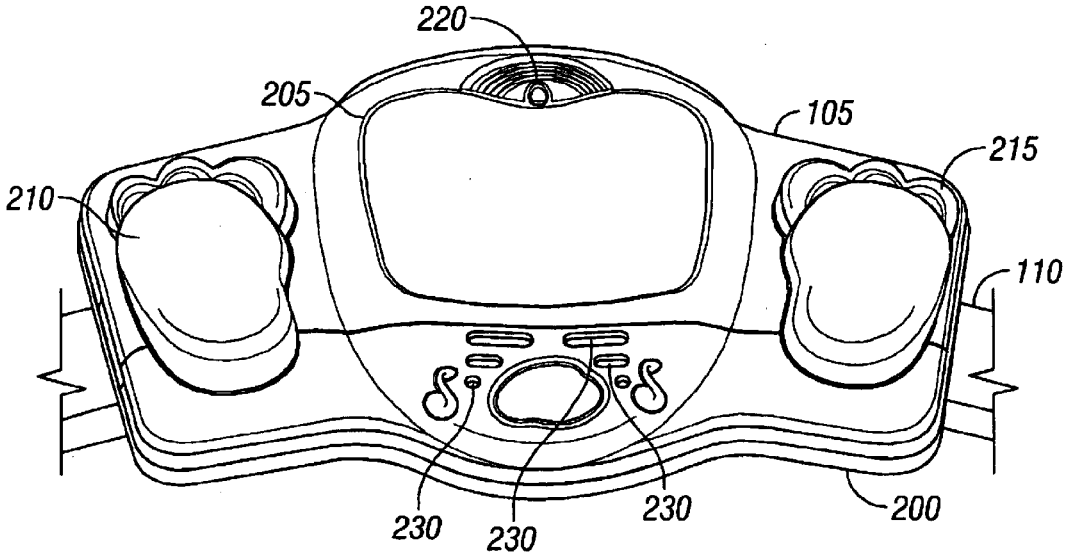
FIGS. 2 and 3 are perspective views of a housing and a base of the toy control unit of FIG. 1.
Figure 3:
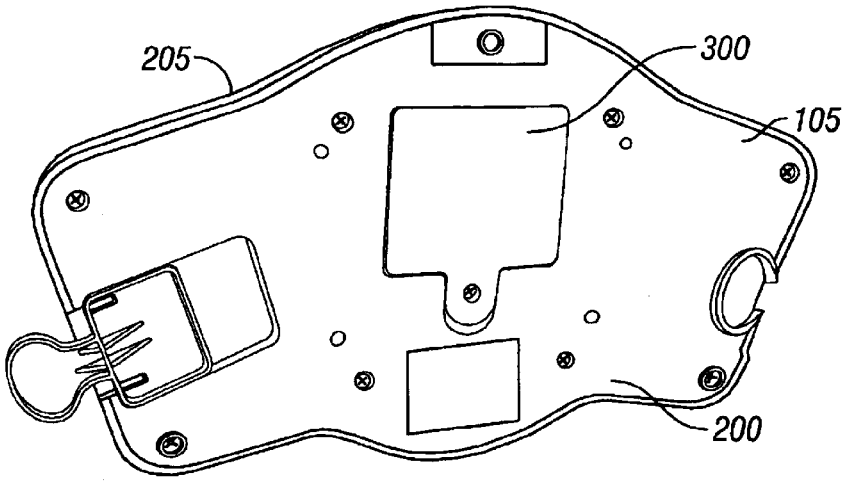
Figure 4:
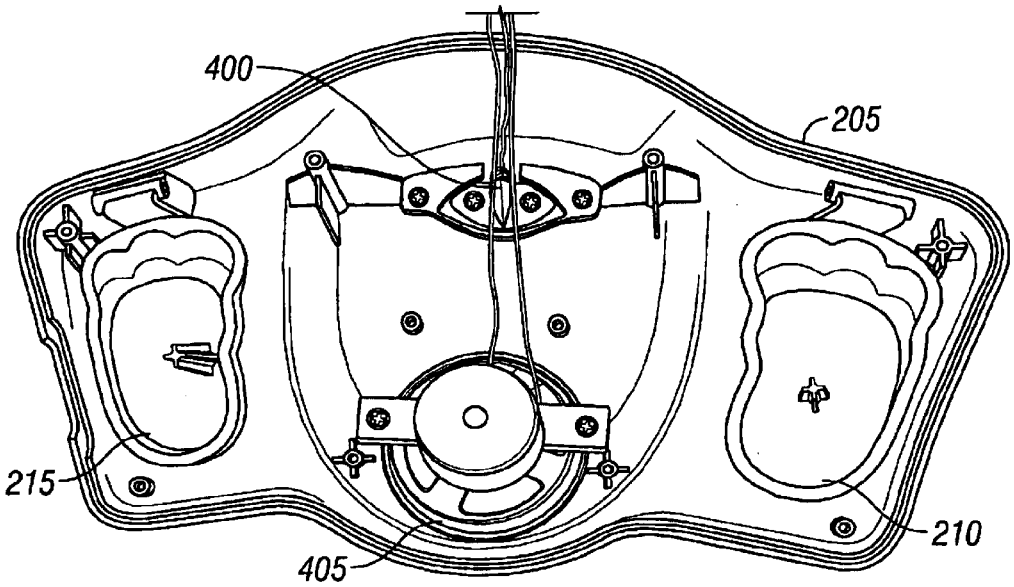
FIG. 4 is an inside perspective view of the housing of the toy control unit of FIG. 1.
Figure 5:
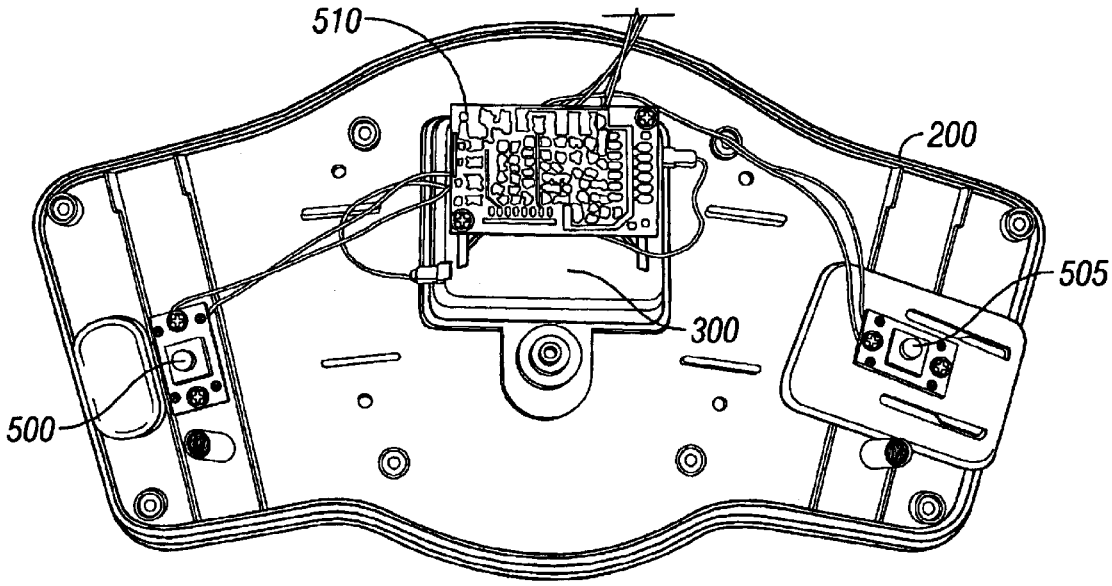
FIG. 5 is an inside perspective view of the base of the toy control unit of FIG. 1.

Referring to FIG. 1, a toy 100 produces an output when a control unit 105 senses an event that occurs within a perimeter defined by a boundary device 110. The toy 100 is designed such that the player moves relative to the boundary device 110 to produce the event and trigger the output from the control unit 105. Accordingly, the toy 100 may be placed on a standing surface (such as a floor in a room) to permit one or more players to walk within or near the boundary device 110.

The boundary device 110 may be made of a durable, safe, and inexpensively fabricated material, such as, for example, plastic. The boundary device 110 may be formed using any suitable molding technique, such as, for example, injection molding into any suitable design such as a circle, an oval, or a special design. As shown in FIG. 1, in one implementation, the boundary device 110 may be shaped with two or more curved segments 115 that are assembled by the players without the aid of additional tools to facilitate assembly and shipping. The curved segments may mate with each other using any suitable fastening mechanism including snap-fit elements or interfitting elements. For example, a curved segment may include a projecting element and an adjacent curved segment may include a recess. The projecting element of the curved segment may be cooperative with the recess of the adjacent curved segment such that the curved segments interfit and releasably interlock.

Referring also to FIGS. 2–5, the control unit 105 includes a base 200 that attaches to a housing 205 for holding components that control operation of the toy 100, as discussed in greater detail below. The base 200 and housing 205 may be made of any of the various materials that have suitable properties (such as, durability, low weight, and safety) for such a toy. For example, suitable materials include, but are not limited to, plastics such as resins, polymers, elastomers, or thermoplastics. The base 200 and the housing 205 may be formed using any suitable molding technique, such as, for example, injection molding.

The housing 205 includes one or more press-buttons 210, 215, 217 for receiving input from a player (for example, an ON/OFF button 217 shown in FIG. 6 or a game button 210, 215) and an opening 220 coupled to a detector 400 to receive player input such as, for example, visual input. Visual input includes, for example, input that indicates an event such as motion or presence of the player. The opening 220 may be formed and positioned at a top of the housing 205 to provide an unobstructed field or region in which to receive the visual input. Therefore, the unobstructed field and the operating properties of the detector 400 define a visual field in which the detector may receive visual input. If designed to detect visual input, the detector 400 may detect visual input at any wavelength or range of wavelengths. Additionally, one or more openings 230 are formed on the housing 205 and positioned relative to an audio device 405 (for example, a speaker) within the housing 205 to permit audio output (for example, music) to emanate from the speaker 405 without being muffled.

Figure 6:
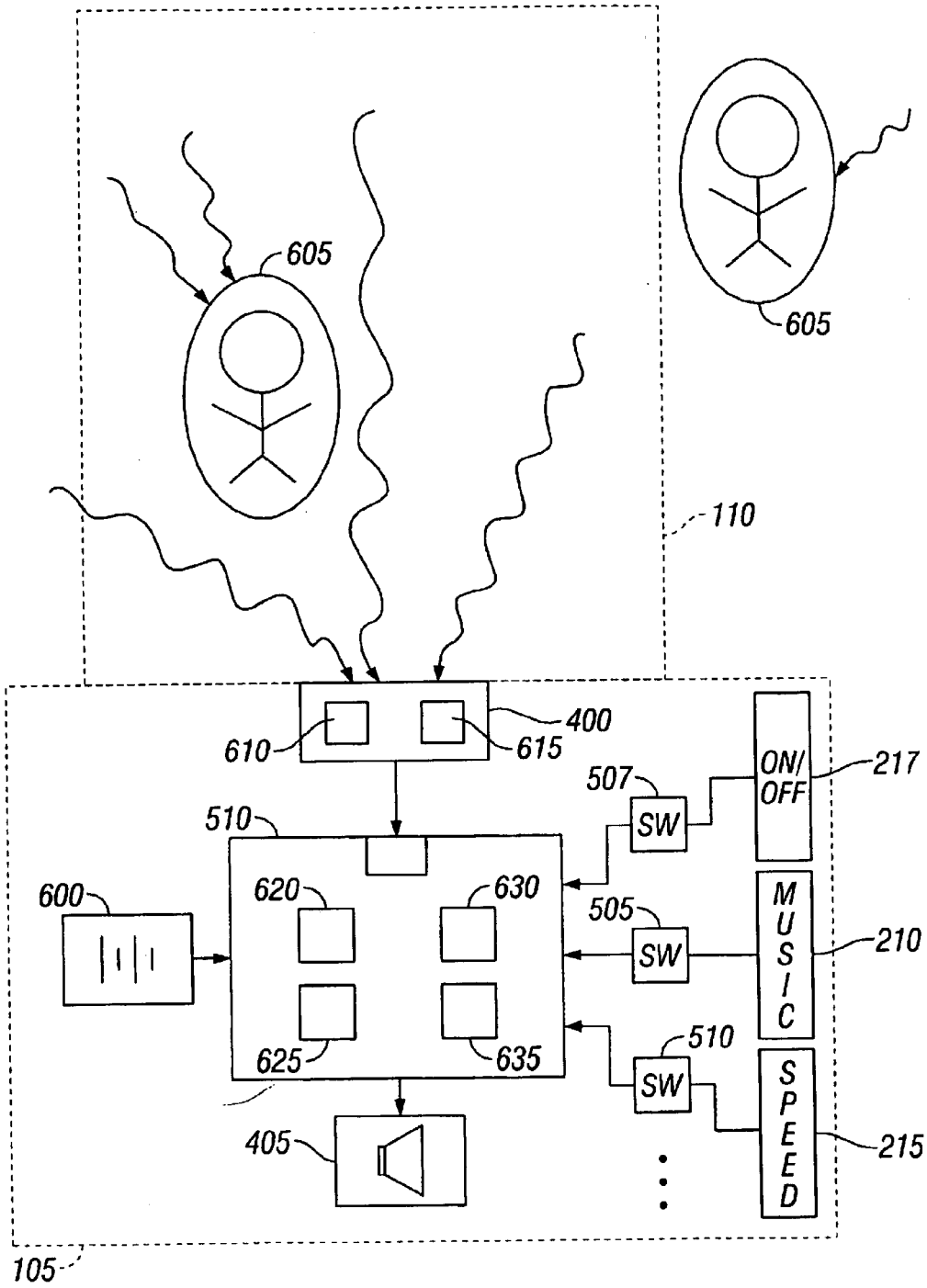
FIG. 6 is a block diagram of the toy of FIG. 1.

Referring also to FIG. 6, the base 200 includes a compartment 300 for housing a power source 600 such as a battery. The compartment 300 may be opened and closed using, for example, a screwdriver or a snap-fit feature. The base 200 also includes one or more switches 500, 505, 507 coupled to the one or more press-buttons 210, 215, 217 on the housing 205. A controller 510 is positioned within the base 200 to receive input from the one or more switches 500, 505, 507, from the power source 600, and from the detector 400.

The detector 400 is designed to receive visual input from an event (such as motion or presence of a player 605) that occurs within the visual field. To accomplish this, the detector 400 includes a sensing device 610, such as a photodiode detector, and corresponding circuitry 615 that converts the visual input into a value that may be interpreted by the controller 510. For example, the detector circuitry 615 may convert light intensity received by the sensing device 610 into a suitable electronic level. The detector 400 may receive visual input at a particular wavelength or intensity. The detector 400 and the controller 510 are designed to send a signal to the speaker 405 if the visual input indicates that an event is occurring within the boundary device 110.

In one implementation, the detector 400 and the controller 510 are designed to detect motion. The detector 400 continuously measures changes in ambient light intensity due to movement of the player 605 within the boundary device 110. In this implementation, there may be difficulties with the amount of ambient light in the area in which the toy 100 is located during play and therefore the amount of ambient light within the visual field. If there is too much ambient light within the visual field, then the controller 510 may receive a signal from the detector 400 indicating motion within the boundary device 110 when the motion actually occurs outside the boundary device 110. If there is too little ambient light within the visual field, then the detector 400 may fail to detect a change in motion within the boundary device 110 even though a player 605 is moving within the boundary device 110. To account for such changes in ambient light intensity, the detector 400 may include a photoresistor that automatically compensates for ambient light fluctuations or a variable resistor that may be used to manually adjust a trigger sensitivity of the detector 400.

In another implementation, the detector 400 and the controller 510 may be designed to detect a presence of a player 605 within the boundary device 110. For example, the sensitivity of the detector 400 may be raised to a level at which a slight motion produces a value that indicates an event occurring within the boundary device 110. In another implementation, the toy 100 may include one or more light sources positioned (for example, along the boundary device 110) to shine light on the detector 400. In this way, the detector 400 may detect a break in the beam of light if the player 605 is present within the boundary device 110. In another implementation, because a player within the boundary device 110 produces an amount of heat that is greater than an ambient amount of heat, the detector 400 may measure relative amounts of heat to determine the presence of the player within the boundary device.

Based on the input from the detector 400 and the one or more push buttons 210, 215, 217, the controller 510 controls the speaker 405. The controller 510 includes a processor 620 that performs the controller's tasks using additional information obtained from memory 625, a clock 630, and a counter 635.

Figure 7:
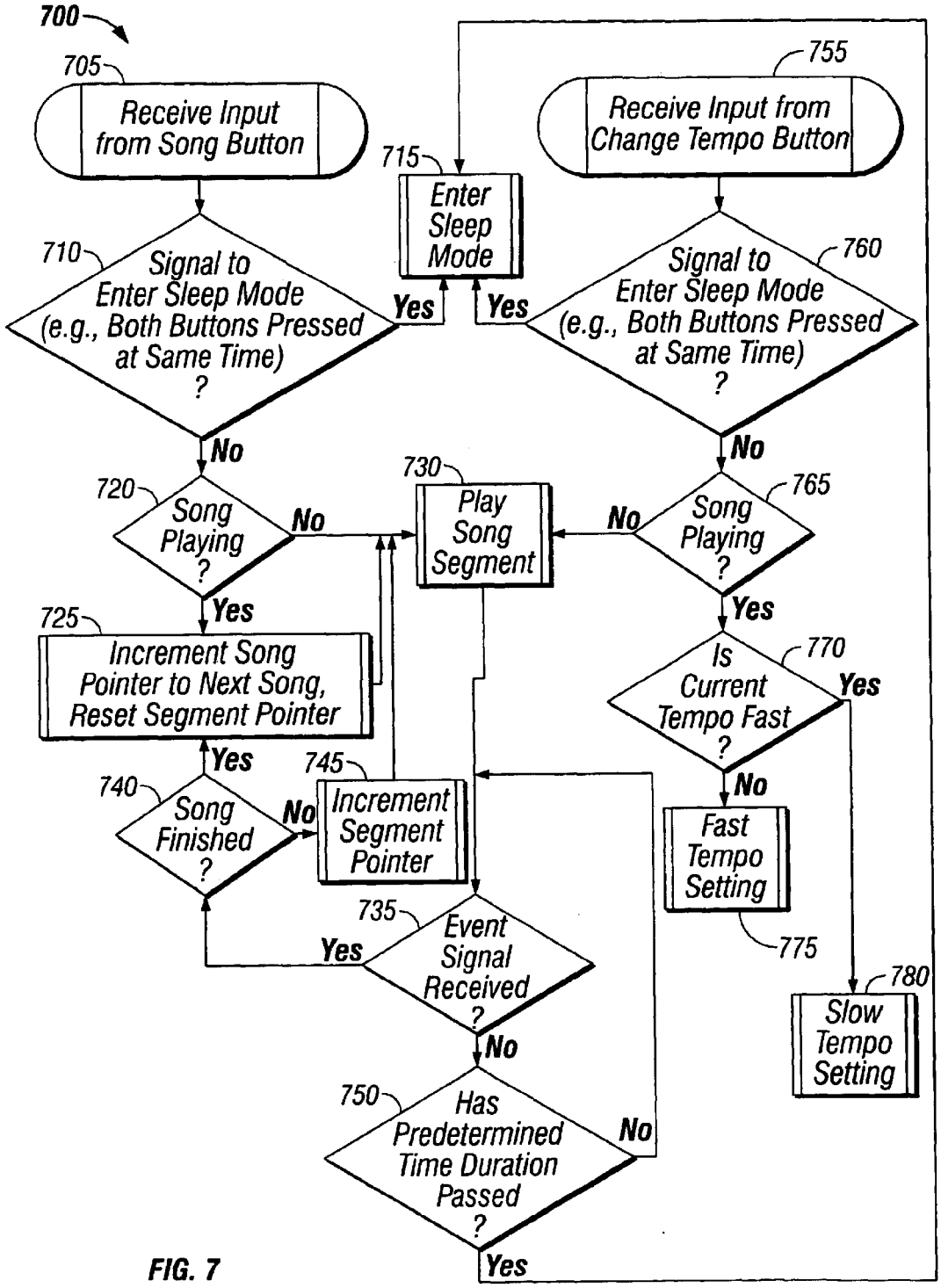
FIG. 7 is a flow chart of a procedure performed by the toy of FIG. 1.

Referring also to FIG. 7, in one implementation, the controller 510 operates the game according to a procedure 700. In this implementation, the push button 210 is a song button that generally causes the controller 510 to play a song segment and the push button 215 is a tempo button that generally causes the controller 510 to change a tempo or speed of a song segment. If the controller 510 determines that input has been received from the song button (step 705), the controller determines whether the player has requested that the toy 100 enter sleep mode (step 710). In sleep mode, the controller does not process input from the detector 400. Moreover, during sleep mode, the toy 100 conserves energy by using less power from the power source. The player may request sleep mode by, for example, pressing the song button and the tempo button simultaneously.

If the controller receives a sleep mode request (step 710), the controller enters sleep mode (step 715). Otherwise, the controller determines whether a song is currently playing (step 720). If a song is currently playing (step 720), the controller increments a song pointer to a next song and resets a song segment pointer (step 725). After incrementing (step 725) or after determining that a song is not currently playing (step 720), the controller sends an output signal to the speaker to play a next song segment (step 730).

The controller then determines whether an event signal has been received (step 735). The event signal is a signal from the detector 400 indicating that an event, such as motion or presence of the player 605 within the boundary device 110, has occurred. As discussed above, if the event is motion of the player 605, then the event signal is triggered by a relative change in light intensity impinging upon the sensing device 610. If the event is a presence of the player 605 within the boundary device 110, then the event signal is triggered by an absolute value of light intensity impinging upon the sensing device 610.

If the controller 510 determines that an event signal has been received (step 735), then the controller 510 determines if the song has finished (step 740). If the song has finished (step 740), the controller increments the song pointer to a next song and resets the segment pointer (step 725), and causes the speaker to play the next song segment (step 730). If the song has not finished (step 740), the controller increments the song segment pointer to the next song segment (step 745) and causes the speaker to play the next song segment (step 730).

If the controller 510 determines that an event signal has not been received (step 735), the controller determines whether a predetermined time duration has passed (step 750). If the predetermined time duration has passed, the controller enters the sleep mode (step 715). Otherwise, the controller awaits receipt of an event signal (step 735).

If the controller 510 determines that input has been received from the tempo button (step 755), the controller may perform actions affecting the tempo of the songs that are played. The controller may perform such actions relating to the song tempo in a background mode, that is, concurrently with or during performance of one or more other actions. In any case, upon receipt of input from the tempo button (step 755), the controller determines whether the player has requested that the toy 100 enter the sleep mode (step 760) by, for example, simultaneously pressing the song button and the tempo button. If the controller does not receive a sleep mode request (step 760), the controller determines whether a song is playing (step 765). If a song is not currently playing (step 765), the controller sends an output signal to the speaker to play the next song segment (step 730). If a song is currently playing (step 765), the controller determines if the tempo of the song is slow or fast (step 770). If the song tempo is slow, the controller changes the tempo setting to a faster tempo setting (step 775). If the song tempo is fast, the controller changes the tempo setting to a slower tempo setting (step 780).

Other implementations are within the scope of the following claims. For example, the controller 510 may produce a visual output from a light source such as a flashing or blinking light. As discussed above, the detector 400 and controller 510 may be designed to detect the presence of a player within the boundary device 110.

When the controller 510 receives input from either of the push buttons 210 or 215 while in sleep mode, the controller 510 may send an output signal to the speaker 405 to play an introduction audio sequence that indicates to the player that the toy 100 is now on. Likewise, the controller 510 may send an output signal to the speaker 405 to play a goodbye audio sequence before entering sleep mode.

The controller 510 may disengage the detector 400 after receipt of the event signal and then engage the detector 400 after a second predetermined duration of time has passed from receipt of the event signal. The second predetermined duration of time may be less than a duration of time required to play a song segment (called a third predetermined duration of time). In this way, the second predetermined duration of time and the third predetermined duration of time may be adjusted to permit continuous play of the music or sounds when activity in the boundary device 110 is continuous, or at least ongoing. For example, the second predetermined duration of time may lapse before the end of the third predetermined duration of time. In one implementation, the third predetermined duration of time is approximately 5 seconds while the second predetermined time duration is less than approximately 5 seconds. The predetermined duration of time may be, for example, 15 seconds, although other suitable durations may be used.

What is claimed is:

1. A toy comprising:

a boundary device configured to be placed on a standing surface and defining a perimeter sized to permit a player to stand within the perimeter; and a control unit connected to the boundary device, the control unit including:

a detector configured to sense that a player is standing within the perimeter, an output device, and a controller that receives input from the detector and sends an output signal to the output device to cause the output device to perform an action when the detector senses that a player is standing within the perimeter.

2. The toy of claim 1 in which the boundary device includes two or more curved segments that are assembled using a fastening mechanism.

3. The toy of claim 1 in which the boundary device is circular.

4. The toy of claim 1 in which the control unit includes an input mechanism for receiving input from a player.

5. The toy of claim 4 in which the input mechanism comprises a push-button.

6. The toy of claim 4 in which the controller causes the output device to perform a second action when the controller receives input from the input mechanism.

7. The toy of claim 6 in which:

the output device includes a speaker;

the controller causes the speaker to play a sound when the detector senses that a player is standing within the perimeter; and the controller causes the speaker to play a second sound when the controller receives input from the input mechanism.

8. The toy of claim 6 in which:

the output device includes a speaker;

the controller causes the speaker to play music when the detector senses that a player is standing within the perimeter; and the controller causes the speaker to play the music at a faster speed when the controller receives input from the input mechanism.

9. The toy of claim 4 in which the controller enters a limited mode when the controller determines that input from the detector has not been received for a period of time that is longer than a predetermined time duration, the controller processing input only from the input mechanism during operation in the limited mode.

10. The toy of claim 4 in which the controller enters a limited mode when the controller receives input from the input mechanism to enter limited mode, the controller processing input only from the input mechanism during operation in the limited mode.

11. The toy of claim 1 in which the output device includes a speaker and the controller causes the speaker to play sounds when the detector senses that a player is standing within the perimeter.

12. The toy of claim 1 in which the controller disengages the detector after the detector senses that a player is standing within the perimeter.

13. The toy of claim 12 in which the controller engages the detector after a second predetermined duration of time following disengagement.

14. The toy of claim 13 in which the controller causes the output device to perform the action for a third predetermined duration of time.

15. The toy of claim 14 in which the second predetermined duration of time lapses before the end of the third predetermined duration of time.

16. The toy of claim 15 in which the controller causes the output device to continuously perform the action when the detector senses that a player is standing within the perimeter before the end of the third predetermined duration of time and after the end of the second predetermined duration of time.

17. The toy of claim 1 in which the detector senses that a player is standing within the perimeter by measuring an ambient light intensity within a visual field and by measuring a change in ambient light intensity when a player moves within the visual field of the detector.

18. The toy of claim 4 in which the controller causes the output device to alter the action when the controller receives input from the input mechanism during performance of the action.

19. The toy of claim 18 in which alteration of the action includes changing a speed at which the action is performed.

20. The toy of claim 18 in which alteration of the action includes changing a type of action that is performed.

21. A method for controlling a toy, the method comprising:

measuring ambient light intensity within an open perimeter defined by a boundary device from a light source outside the perimeter;

determining whether a change in ambient light intensity occurs within the perimeter based on the measuring; and sending an output signal to an output device that causes the output device to perform a first action when it is determined that a change in ambient light intensity occurs within the perimeter.

22. The method of claim 21 further comprising receiving input from an input mechanism that is triggered by action of a player.

23. The method of claim 22 further comprising sending an output signal to the output device that causes the output device to perform a second action when input from the input mechanism is received.

24. The method of claim 23 in which the output device includes a speaker.

25. The method of claim 24 further comprising causing the speaker to play a first sound when it is determined that a change in ambient light intensity occurs within the perimeter and causing the speaker to play a second sound when receiving input from the input mechanism.

26. The method of claim 24 further comprising causing the speaker to play music at a first speed when it is determined that a change in ambient light intensity occurs within the perimeter and causing the speaker to play the music at a second speed that is faster than the first speed when receiving input from the input mechanism.

27. The method of claim 24 further comprising causing the speaker to play sounds when it is determined that a change in ambient light intensity occurs within the perimeter.

28. The method of claim 21 further comprising adjusting a sensitivity at which ambient light intensity is measured.

29. The method of claim 28 in which determining whether a change in ambient light intensity occurs within the perimeter includes receiving a measurement from a detector of a change in ambient light intensity that occurs when a player moves within a visual field of the detector.

30. The method of claim 22 further comprising altering the output signal to the output device when input is received from the input mechanism during performance of the first action.

31. A toy comprising:

a boundary device that defines a perimeter;

a control unit coupled to the boundary device, the control unit including:

a detector configured to measure light intensity within the perimeter from a light source outside the perimeter, an output device, and a controller that receives input from the detector and sends an output signal to the output device to cause the output device to perform an action when the detector senses a change in light intensity that occurs within the perimeter.

32. The toy of claim 31 in which the detector includes a resistor device configured to compensate for background fluctuations in ambient light intensity the perimeter.

* * * * *